US005174514A

United States Patent [19]

Prodi

[11] Patent Number: 5,174,514

[45] Date of Patent: Dec. 29, 1992

[54] THREAD-LAYING DEVICE WITH ROTATING THREAD-GUIDE ELEMENTS ON TWO CONVERGING INCLINED PLANES

[75] Inventor: Paolo Prodi, Ravenna, Italy

[73] Assignee: Savio S.p.A., Pordenone, Italy

[21] Appl. No.: 797,437

[22] Filed: Nov. 22, 1991

[30] Foreign Application Priority Data

Nov. 23, 1990 [IT] Italy ..... 22174 A/90

[51] Int. Cl.[5] ..... B65H 54/28

[52] U.S. Cl. ..... 242/43 A

[58] Field of Search ..... 242/43 A, 43 R, 158 B

[56] References Cited

U.S. PATENT DOCUMENTS

| | | | |
|---|---|---|---|
| 3,650,486 | 3/1972 | Hasegawa et al. | 242/43 A |
| 4,349,160 | 9/1982 | Niederer | 242/43 A X |
| 4,505,437 | 3/1985 | Schippers et al. | 242/43 A |
| 4,991,783 | 2/1991 | Sugioka | 242/43 A |

FOREIGN PATENT DOCUMENTS 0382104 8/1990 European Pat. Off. .

*Primary Examiner*—Stanley N. Gilreath
*Attorney, Agent, or Firm*—George P. Hoare, Jr.

[57] ABSTRACT

The present invention relates to a thread-laying device with several rotating thread-guide elements, producing an alternating to-and-fro movement of synthetic or natural threads, supplied at high speed, in which the said device has its rotating thread-guide elements arranged in two groups which work together to wind the thread crisscrossed, and each group is positioned on an inclined plane in relation to the plane normal to the direction of downward movement of the thread and the said inclined planes converge in a vertex close to the said thread. The inclinations of the two said planes in relation to the normal plane have values which differ greatly from each other and the angle of their vertex has an essentially consistent value.

8 Claims, 5 Drawing Sheets

Figure 1:
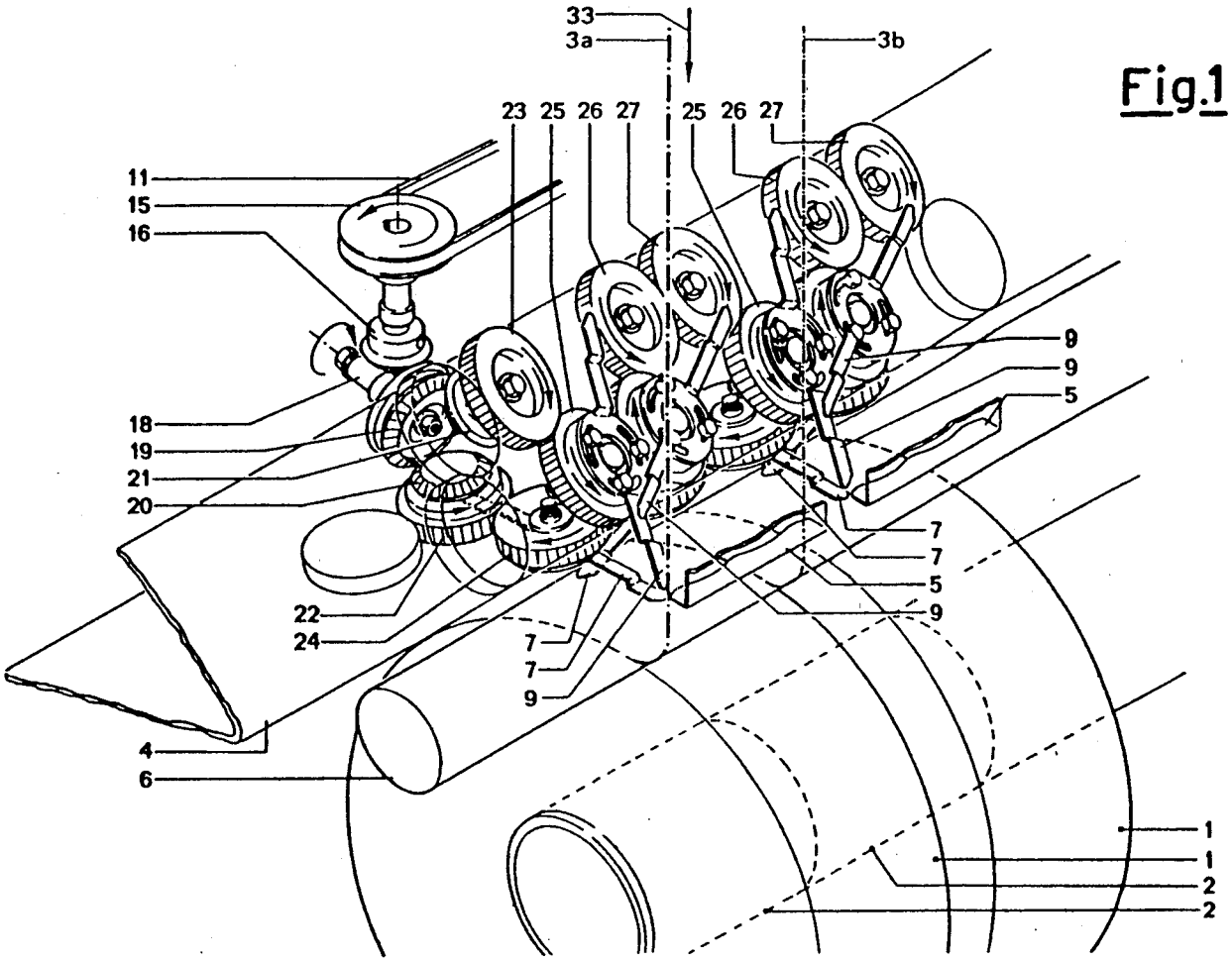

THREAD-LAYING DEVICE WITH ROTATING THREAD-GUIDE ELEMENTS ON TWO CONVERGING INCLINED PLANES

The present invention relates to a thread-laying device with several thread-guide elements in constant rotation, which effect the alternating to-and-fro movement of synthetic or natural threads, supplied at high speed in winding frames.

More particularly, the device according to the present invention may be adopted advantageously, although not restrictively, in collector units used for winding synthetic yarns that have just been spun at a high production speed. In the explanation that follows and in the claims, the term "yarn" refers to any type of threadlike product and the term "cop" refers to the product of a winding machine of whatever form.

Within the field of textile machinery it is known how the machines, or units that wind yarns, must guarantee the integrity of the yarns, which are coiled in layers superimposed on the surface of the cops being formed. In this crisscross layering it is essential that neither the winding in progress, nor the subsequent unwinding are hindered in the series of technological operations that the yarn is to undergo. In practice it would be desirable that the thread-guide elements used for the alternating movement of the yarn, in one direction and the other in relation to the rotating cop, should not cause more or less violent jerking of the yarn so as to damage and at worst break it.

A great problem in known thread-guide devices is the limitation of the maximum speed at which the elements that move the yarn to and fro to create the crisscross winding can operate and, in particular, the considerable difficulties that the said elements encounter on moving the thread at travel reversal points so as to achieve collection without deterioration in the quality and shape of the cop being formed.

Various techniques are offered by known thread-guide devices for moving the thread backwards and forwards on a cop rotating at high speed. For example, elements with an oscillating or alternating movement have been tried, mounted on gears or belts or similar devices, or else cams or double-threaded screws or several counter-rotating flyers have been used.

With the latter flyer devices, the thread is moved in one direction along the axis of the cop rotating around itself by a constantly rotating flyer and is then intercepted by an additional flyer which rotates in the opposite direction and which, consequently, brings it back in the opposite direction along the axis of the cop. This to and fro movement of the thread clearly produces the crisscross winding of the thread on the bobbin so as to form the cop.

The above-mentioned movement devices, widely used for some time in the known state of the art, suffer from considerable drawbacks in that they have considerable inertia of moving masses subjected to strong reactions at each reversal, or delicate devices which due to the effect of rubbing tend to wear rapidly and absorb energy due to passive resistance, which means that they do not lend themselves to high speeds and consequently constitute an obstacle to an increase in production in yarn- or continuous-thread winding machines.

While the above-mentioned counter-rotating flyer movement devices, recently widely used for high-speed winding of synthetic threads, may appear almost perfect under certain conditions, it has been observed in practice that certain difficulties arise at the moment of reaching the end of travel of the alternating movements, especially when these counter-rotating flyers are used at high speed.

This means that with these flyer devices, in the various forms of embodiment already proposed in the state of the art, the yarn might not be positioned uniformly at the ends of the cop thus causing the side parts to come undone, or damage may be caused to the threadlike material particularly if the latter is delicate.

The above-mentioned defects make the cop practically unusable in subsequent working processes and make it impossible for the cop to be rewound without breaking the thread. One form of embodiment of a flyer device is described in U.S. Pat. No. 4,505,436 in which the counter-rotating flyers are arranged on superimposed parallel planes. This arrangement certainly enables high thread-laying speeds with alternating movements and therefore high winding speeds, but on the other hand it has drawbacks caused by abnormal tension created in the moving thread each time the movement is reversed because the two counter-rotating flyers, the one that releases and the other that picks up the thread, are not arranged in a reciprocal position so as to ease the exchange.

Incidentally, the exchange at the ends is the most critical and stressed point in the transverse movement of the thread by counter-rotating flyers, as the experts within the field well know.

The known device of the above-mentioned patent has various operating anomalies as regards the exchange of the thread at the ends of its travel because its flyers are superimposed and parallel and therefore encourage instability of the thread guide at the reversal points. This device does not, therefore, prevent interruptions in cop production, neither does it prevent damage to the threadlike material being wound, nor does it enable the higher winding speeds to be reached. Since, in the case of synthetic threads, it is nowadays possible to achieve spinning speeds of over five thousand meters per minute, the measures so far taken into consideration are inadequate for forming cops of faultless quality and shape.

With the device covered by the present invention, it is surprisingly possible to achieve an exchange of thread between the counter-rotating flyers at the reversal points of the transverse travel without creating tensions that would damage the thread, so that the cop being formed has the best winding of the various layers of thread. Perfect exchange also enables the higher winding speeds of the spun thread to be reached, i.e. the maximum winding speed is that permitted by the actual spinning process itself.

The aim of the present invention is to eliminate the above-mentioned disadvantages and provide a thread-laying device with rotating thread-guide elements which enable crisscross winding at high speeds, in the order of five thousand or more meters per minute, so as to ensure the creation of cylindrical cops with optimum characteristics, in order to be able to be used without any difficulty in the processes that follow winding. One aim of the invention is therefore to produce a thread-moving device suitable for high speeds.

Another aim is that the travelling thread-movement device, operating at high speed, requires no elements having an alternating motion and, therefore, the device is completely free of the inertia of masses in motion subject to strong reactions at each reversal of the transverse movement of the thread being wound due to the accelerations and decelerations inherent in the system. All this eliminates the presence of delicate devices prone to rapid wear and also eliminates the presence of great absorption of energy due to passive resistance.

Another aim is to provide a device for axial movement of the thread which controls its reversal point very accurately and correctly so as to create spools which have not even the slightest imperfections in their winding form. An additional aim is that the device, although very efficient, is not too expensive. These and other aims of the invention, which will emerge more clearly in the course of the description, are achieved by the thread-laying device with several constantly-rotating thread-guide elements for forming crisscross-wound cops of synthetic or natural threads, supplied at high speed, in which the said device in question has its rotating thread-guide elements arranged in two groups which work together to wind the thread crisscrossed, and each group lies on an inclined plane in relation to the plane normal to the direction of movement of the thread and the said inclined planes converge close to the thread, which is moved transversely by the said thread-guide elements to distribute it in coils onto the surface of the cop being formed and the inclinations of the two said planes in relation to the normal plane have values which differ greatly from each other and the inclined planes having an angle of their vertex of an essentially consistent value.

An important characteristic of the thread-laying device covered by the present invention lies in the fact that the two inclined planes of the thread-guide elements each occupy opposing spaces, i.e. one plane is above whilst the other is below the plane normal to the direction of movement of the thread and the said top plane with the greater inclination in relation to the plane normal to the thread contains the thread-guide elements which move the thread transversely from the extreme edges to the central area of the cop, whereas the said bottom plane with the smaller inclination in relation to the said plane normal to the thread contains the thread-guide elements, which move the thread transversely from the center to the extreme edges of the cop being formed.

According to one form of embodiment the thread-laying device in question has on each of its two above-mentioned inclined planes at least two thread-guide elements, which move the thread transversely.

According to another form of embodiment the thread-laying device in question has its lower plane, on which lie and rotate the thread-guide elements, which move the thread transversely from the center to the extreme edges of the cops, essentially coinciding with the plane normal to the direction of movement of the thread.

Figure 6:
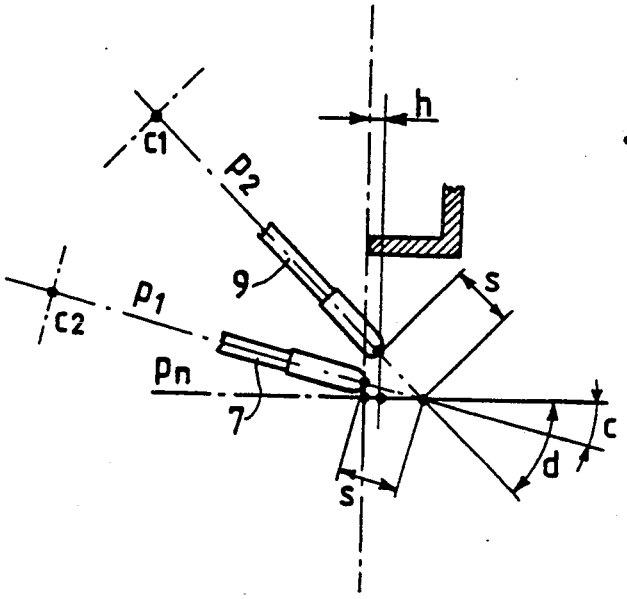
Figure 7:
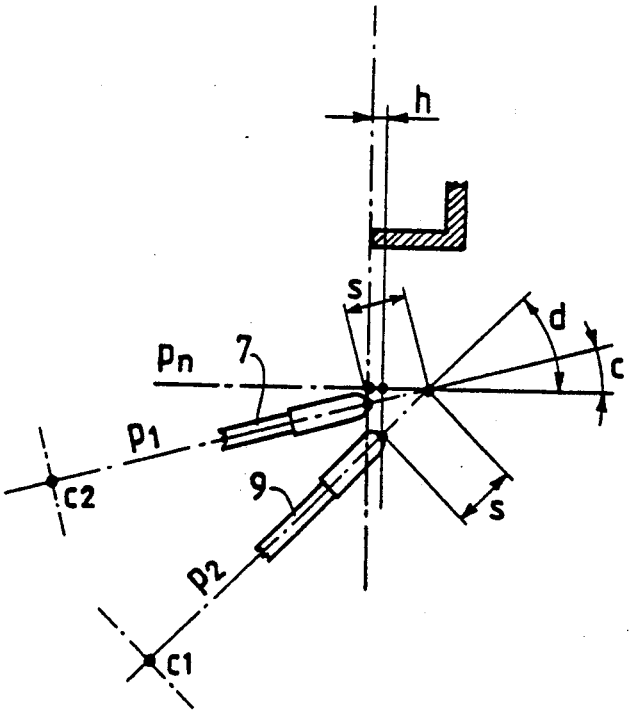

According to another form of embodiment the thread-laying device in question has its two inclined planes containing the thread-guide elements positioned in the same space in relation to the plane normal to the direction of movement of the thread i.e. both are above (as shown in FIG. 6) or both are below (as shown in FIG. 7) the said plane normal to the direction of movement of the thread being wound onto the surface of the cop being formed.

The invention shall be described in greater detail below on the basis of the example of embodiment shown in the drawings of the attached figures, and additional details and characteristics shall be clarified, concerning which it must be understood that any variations in the reciprocal positions of the elements and the consequent simplifications that could arise therefrom must be deemed to be within the protection being applied for as constructional variations covered by the general concept.

Figure 2:
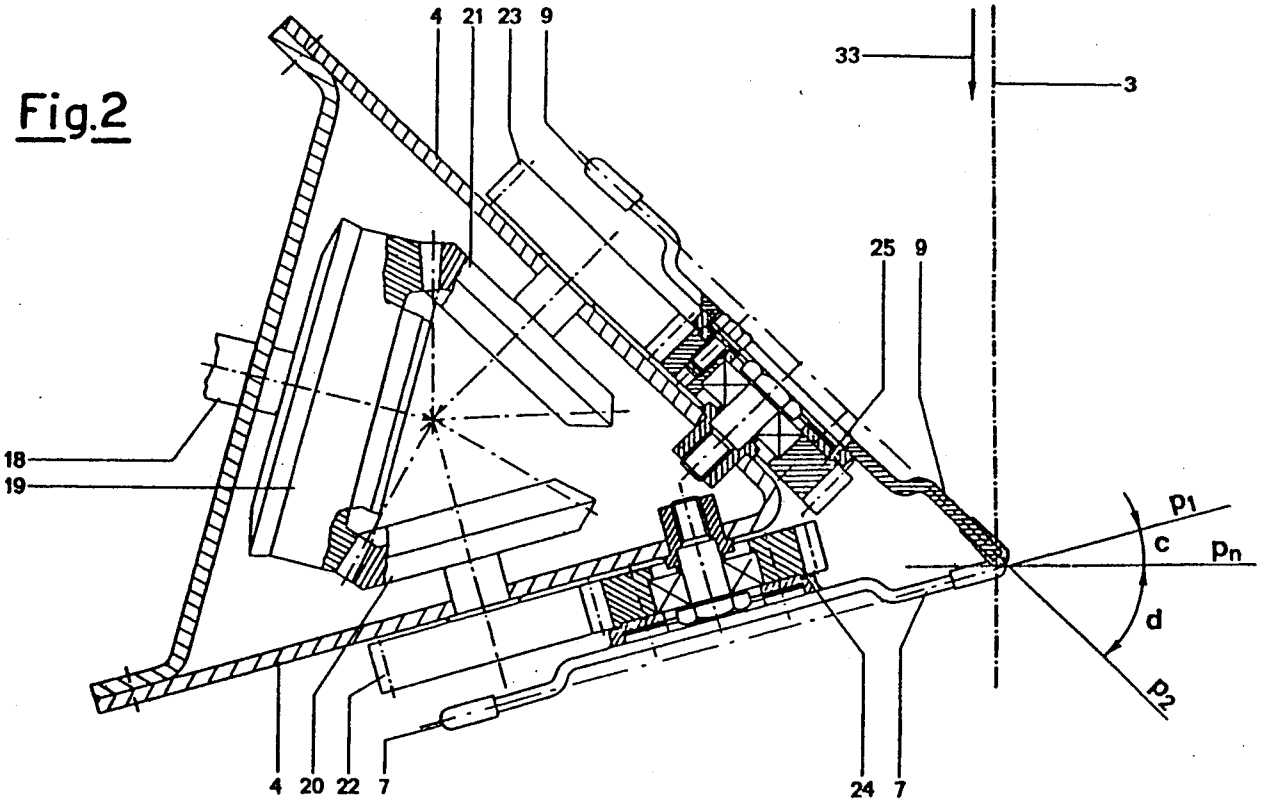
Figure 3:
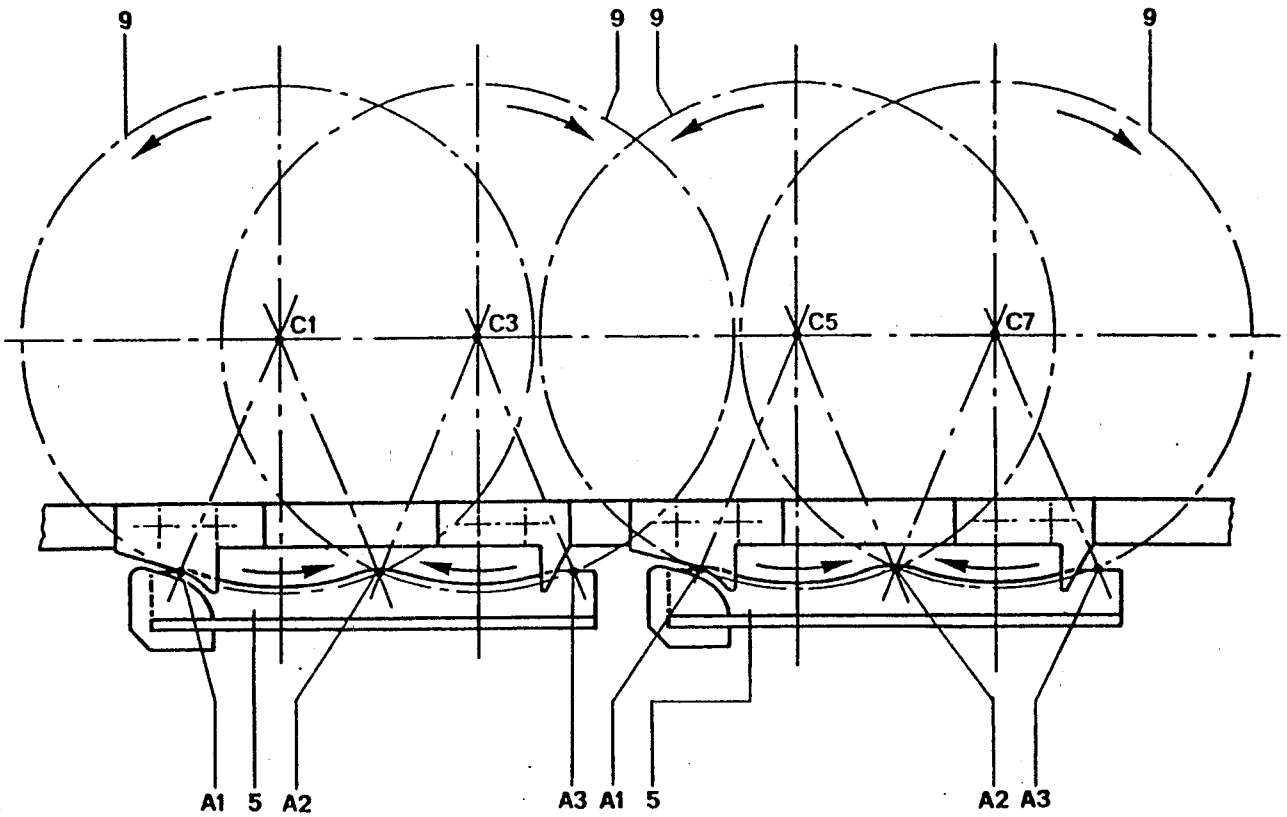
Figure 5:
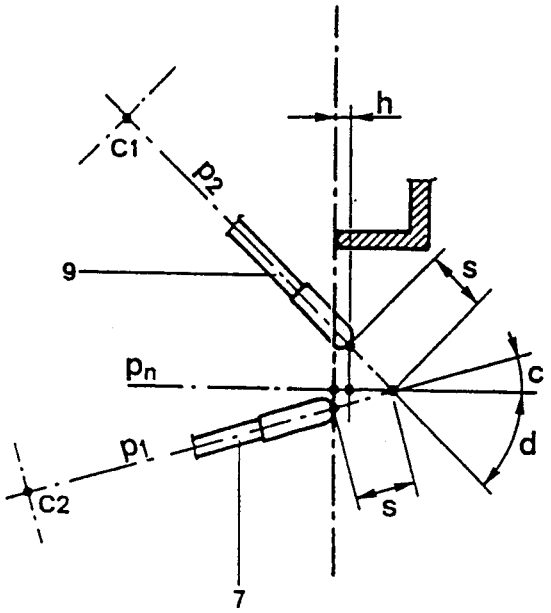
Figure 4:
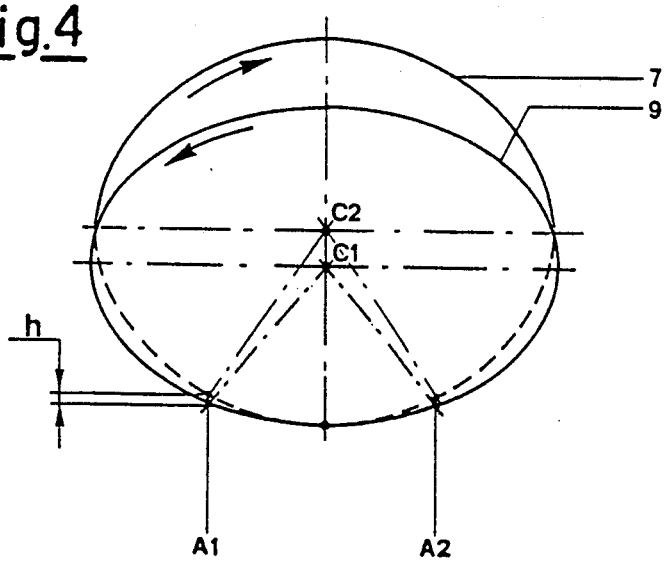

In the attached drawings:

FIG. 1 is an axonometric schematic view of the device covered by the present invention which shows the multi-gear kinematic mechanism for rotating the thread-guide elements, the latter being arranged in two groups which co-operate together to crisscross wind the thread, and the figure also shows the line of the vertical direction of movement of the thread together with the guide roller, which rests on two cops below being formed;

FIG. 2 is a cross-sectional schematic front view of the thread-laying device covered by the present invention and the said view shows both the side profile of the two rotating thread-guide elements and the lines of the planes in which they lie and the said planes in which they lie are inclined in relation to the line of the plane normal to the vertical direction of movement of the thread and they also converge close to the thread;

FIG. 3 is a schematic top view in a direction perpendicular to the plane in which the top thread-guide elements lie and more precisely, the said figure shows the circumferential lines of the ends of the counter-rotating elements, two for each cop being formed, which move the thread transversely from the extreme edges to the central area of the cop, and the figure also shows the outline of the known fixed flat elements which guide and position the thread during its crisscross winding operating stage;

FIG. 4 is an axonometric schematic view of the circumferential trajectories of the ends of one of the top thread-quide elements and of the corresponding bottom thread-guide element and the said circumferential trajectories are shown in their geometrical configuration of projection on the plane perpendicular to the direction of the thread at the points where it is drawn transversely and the said figure shows particularly the greater degree of projection of the top thread-guide element in relation to the bottom thread-guide element at the end point and reversal point of the transverse movement of the thread and at the points of the entire drawing length shown and projected on the said plane perpendicular to the direction of vertical movement of the thread being wound;

FIG. 5 is a schematic side view at the moment of exchange of drawing the thread between the bottom thread-guide element and top thread-guide element at their crossover point at one end of the transverse movement of the thread and more precisely the said figure shows the moment when the bottom thread-guide element releases the thread and the top thread-guide element picks it up with a sufficient and ensured support projection;

FIG. 6 is a schematic side view similar to FIG. 5 wherein the bottom and top thread guides are both above the plane normal to the direction of movement of the thread; and FIG. 7 is schematic side view similar to FIG. 5 wherein the bottom and top thread guides are both below the plane normal to the direction of movement of the thread.

In the figures corresponding parts, or parts that have the same functions, bear the same references for the sake of simplicity.

Moreover, in the figures, for the purpose of clarity of the whole, those parts which are not necessary for understanding the invention, such as the motor for rotating the thread-guide elements, the operating units for forming and supplying the thread, the various supporting structures and other known elements, have been omitted.

In the said attached figures: 1 shows the cop of wound thread being formed and the said cop is followed by one or more cops to form the package on the spindle of a collector unit; 2 shows the cylindrical bobbin supporting the wound thread of cop 1 and the said bobbin, as is well known, is secured to the motorised spindle of the collector unit; 3 shows the line of the thread being supplied which winds in crisscross coils onto the outer circumferential surface of cop 1 being formed; 4 shows the box support of the entire kinematic mechanism that moves the thread-guide elements, which form the operational part of the thread-laying device covered by the present invention; 5 shows the fixed flat element which, with its suitably-shaped front edge, guides and positions thread 3 in its transverse to and fro movement during its crisscross winding operating stage; 6 shows the feeler motor-roller, or pressure roller, which turns in constant contact with cop 1, or with several cops 1, and has the purpose, as is well known to the experts within the field, of checking the number of turns of the cop-holder spindle in order to keep the collection speed of thread 3 on cop 1 being formed uniform; 7 shows the bottom rotating thread-guide element, i.e. the element that lies along the inclined plane of line P1, and the said thread-guide element 7 moves thread 3 transversely from the center to the extreme edges of cop 1 being formed; 9 shows the top rotating thread-guide element, i.e. the element that lies along the inclined plane of line P2, the said thread-guide element 9 moves thread 3 transversely from the extreme edges to the central area of cop 1; 11 shows the drive belt, or similar element which, driven by a synchronous, or asynchronous, motor (not shown since unnecessary for understanding the invention), rotates pulley 15, the latter transfers the rotary motion to shaft 18 via the pair of gears 16 and 19. From bevel gear 19 the rotary motion is transmitted to gear wheels 20 and 21. Gear wheel 20, via gears 22 and 24, transmits the rotary motion to thread-guide element 7, which lies along the bottom plane of line P1 and which moves thread 3 transversely from center A2 to the extreme edges A1 and A3 of cop 1 being formed. Gear wheel 21, via gears 23 and 25, transmits the rotary motion to thread-guide element 9, which lies along the top plane of line P2 and which moves thread 3 transversely from the extreme edges A1 and A3 to the central area A2 of cop 1 being formed; 26 and 27 show the wheels of the gear, which transmits the rotary motion to gear wheels 25, which are integral with top thread-guide elements 9.

The said thread-guide elements 9 are positioned one after the other and for each cop being formed two consecutive counter-rotating elements are used (see FIG. 3); C1, C3, C5 and C7 are the centres of rotation of the four thread-guide elements 9 used to form the two adjacent cops 1 and the said centres of rotation lie along the plane of line P2, which has a marked inclination "d" in comparison to the essentially horizontal plane of line Pn. This latter plane of line Pn represents the plane normal to the direction 33 of movement of thread 3; **3*a* and 3*b* show the two separate threads, which each supply one of the two adjacent cops 1 below and the said cops 1 have a rotary motion since their support bobbin 2 is fixed rigidly onto the spindle of the collector unit, as is well-known to the experts within the field; C2 shows the centre of rotation of a thread-guide element 7 and the said centre of rotation C2 lies along the plane of line p1**, this plane has a slight inclination "c" in comparison to the essentially horizontal plane of line Pn.

Inclination "c" is considerably less than the above-mentioned inclination "d"; A1 and A3 show the extreme points of the transverse movement of thread 3 being wound in crisscross coils onto cop 1 and at the said points A1 and A3 the bottom thread-guide element 7 disengages and releases thread 3 while in the meantime the top thread-guide element 9 picks it up with a sufficient support protrusion "h", as shown in FIGS. 4 and 5. Incidentally, value "h" is the projection of the protrusion of top thread-guide element 9 in relation to bottom thread-guide element 7 along the normal plane of line Pn, and the said thread-guide elements 7 and 9 have at the moment of their crossover a distance "s" between their ends and the vertex at which the planes in which they lie P1 and P1 converge (see FIG. 5).

The said ends of thread-guide elements 7 and 9 are advantageously contoured and shaped in geometrical forms suitable for moving thread 3 backwards and forwards without damaging the thread.

The operation of the thread-laying device covered by the present invention is easily understood both from the above explanation and the description of its various elements and kinematic mechanisms as well as from that illustrated in the attached figures.

The procedure of supplying a thread from a spinner and its being picked up in a collector unit for winding is known.

In the form of embodiment shown in FIG. 1 supply thread 3 is inserted under pressure-roller 6 against the front edge of fixed flat element 5, as is generally known and therefore no further explanation is required.

Thread 3 is then inserted through the notch at end A1 (see FIG. 3).

Incidentally, the insertion notch is a slit between the flat elements positioned at one end of fixed guide element 5 and the said insertion has been known for some time and used when winding threads in collector units.

At the time of insertion, thread 3 is at end point A1 and around said point A1 top rotating thread-guide element 9 interferes at the front with thread 3 pushing it transversely from point A1 to point A2. The said front interference occurs with a support protrusion of value "h" which ensures that the moment of contact and initial push is stable and therefore without any operating difficulties. At the moment of interference at point A1 between element 9 and thread 3 counter-rotating bottom thread-guide element 7 touches thread 3 without interfering with it due to the effect of the different inclination between the two said elements 7 and 9 in relation to plane Pn and in this latter plane their projections differ by value "h" as shown in FIGS. 5 and 4.

Incidentally, the top and bottom thread-guide elements 9 and 7 are of the same size and are therefore advantageously interchangeable on assembly of the device covered by the present invention.

When thread-guide element 9, due to the effect of its front push, has moved thread 3 to point A2, essentially along the centre line of the axial length of cop 1 below, it releases the thread, which is picked up and pushed frontwards by bottom thread-guide element 7 which moves it from point A2 to point A3.

Point A3 coincides essentially with the axial end of cop 1 below and at the said point A3 the exchange of thread 3 is repeated from bottom thread-guide element 7 to top thread-guide element 9, which rests against thread 3 with a front interference of value "h" which ensures that the moment of contact and initial push is stable and therefore without any operating difficulties. Clearly, this sequence is similar to that described above for point A1. Thread 3 is again moved to point A2 where it is again released by top thread-guide element 9 to be picked up by bottom thread-guide element 7 which moves it to point A1 from where the new to-and-fro cycle is repeated.

Thread 3 continues in an alternating straight motion governed by the rotation of the rotating thread-guide elements, which distribute the thread in continuous supply 33 onto rotating cop 1 forming a progressive crisscross winding and thus a gradual consequent increase in the diameter of cop 1.

The thread-laying device thus conceived may undergo numerous modifications and variations which all fall within the scope of the invention. Thus for example the means that confer upon the top and bottom thread-guide elements such concordant and discordant rotations may also be made differently in accordance with known concepts. Control devices set in motion by independent driving organs, but having an operation which is mechanically- or even electrically- or electronically-synchronised, for example, will fall within this scope. In practice the elements shown may be replaced by others which are technically equivalent, without going beyond the scope of the present invention.

I claim:

1. A device for winding thread crisscrossed on a cop, wherein the thread is fed in a path to the device, comprising:

a) a plurality of first thread guide elements attached to the device, wherein said first thread guide elements rotate in a first plane and are adapted for transversely guiding the thread from an end of the cop toward the center of the cop, and wherein said first plane forms a first angle with the thread path;

b) a plurality of second thread guide elements attached to the device, wherein said second thread guide elements rotate in a second plane and are adapted for transversely guiding the thread from the center of the cop toward an end of the cop, wherein said second plane forms a second angle with the thread path and wherein said first angle differs from said second angle.

2. The device of claim 1, wherein said first angle comprises an acute angle and said second angle comprises an obtuse angle.

3. The device of claim 2, wherein said first plane and said second plane intersect at a substantially constant angle.

4. The device of claim 3, wherein said plurality of first thread guide elements are above a plane perpendicular to the thread path and said plurality of second thread guide elements are below the plane perpendicular to the thread path, and wherein said first plane has a greater inclination from the plane perpendicular to the thread path than the inclination of said second plane from the plane perpendicular to the thread path.

5. The device of claim 4, wherein said plurality of first thread guide elements comprises two first thread guide elements, and wherein said plurality of second thread guide elements comprises two second thread guide elements.

6. The device of claim 3, wherein said plurality of first thread guide elements and said plurality of second thread guide elements are above a plane perpendicular to the thread path.

7. The device of claim 3, wherein said plurality of first thread guide elements and said plurality of second thread guide elements are below a plane perpendicular to the thread path.

8. The device of claim 1, wherein said second plane is substantially perpendicular to the thread path.

* * * * *